US005328154A

United States Patent [19]

Blatz et al.

[11] Patent Number: 5,328,154

[45] Date of Patent: Jul. 12, 1994

[54] MULTI-TIERED SYSTEM OF LEVELLER UNITS

[75] Inventors: Warren J. Blatz; David J. King; Gordon G. Wilson, all of Calgary, Canada

[73] Assignee: Tri-Lynx Corporation Ltd., Galgary, Canada

[21] Appl. No.: 947,220

[22] Filed: Sep. 18, 1992

[51] Int. Cl.[5] ..... E02C 3/00

[52] U.S. Cl. ..... 254/88

[58] Field of Search ..... 254/88; 152/213 R; 188/32; 248/352; 446/124–128; 269/296, 16; 7/118, 158; 14/69.5, 71.1

[56] References Cited

U.S. PATENT DOCUMENTS

| | | | |
|---|---|---|---|
| 3,162,973 | 12/1964 | Christiansen | 446/128 |
| 3,487,579 | 1/1970 | Brettingen | 446/128 |
| 3,752,441 | 8/1973 | Rogers | 254/88 |
| 4,026,086 | 5/1977 | Langley | 446/125 |
| 4,165,862 | 8/1979 | Bennett | 254/88 |
| 4,427,179 | 1/1984 | Price | 254/88 |
| 4,548,392 | 10/1985 | Rickling | 269/296 |
| 4,606,732 | 8/1986 | Lyman . | |
| 4,744,780 | 5/1988 | Volpe . | |
| 4,819,910 | 4/1989 | Johnston | 254/88 |
| 4,836,501 | 6/1989 | Baer . | |

FOREIGN PATENT DOCUMENTS

| | | | |
|---|---|---|---|
| 242955 | 2/1960 | Australia | 446/128 |
| 80935 | 8/1951 | Czechoslovakia | 446/128 |
| 1070420 | 12/1959 | Fed. Rep. of Germany | 446/128 |
| 374571 | 1/1940 | Italy | 446/128 |
| 355070 | 7/1961 | Switzerland | 446/128 |
| 1194445 | 6/1970 | United Kingdom | 446/128 |

*Primary Examiner*—Robert C. Watson
*Attorney, Agent, or Firm*—Dykema Gossett

[57] ABSTRACT

A multi-tiered system of leveller units for the levelling of recreational vehicles. The leveller units each comprise a planar body, with upper and lower surfaces circumscribed by edges. The body of each unit bears a plurality of pins upwardly extending from spaced locations in the upper surface and has a plurality of pin-engaging pockets formed in the lower surface to matably receive corresponding pins of other similar units. The pins are of slightly smaller size than the corresponding pockets so that when the pins of one unit are associated with the pockets of another, there is provided a loose engagement therebetween. The body may be formed of a discontinuous webbing providing light-weight strength and support to the units to support the large loads placed thereupon.

18 Claims, 3 Drawing Sheets

MULTI-TIERED SYSTEM OF LEVELLER UNITS

FIELD OF THE INVENTION

The invention relates to levelling devices for vehicles, especially large, recreational vehicles and trailers.

BACKGROUND OF THE INVENTION

Recreational vehicles must be maintained in a level, horizontal position when parked in order to ensure comfort and proper operation of appliances, tables, and the like. Hydraulic and electric jacks exist to accomplish this task. These tend however to be both very expensive and difficult to install and operate.

For simpler levelling devices which are intended to fit under one or more of the vehicle's wheels, a variety of difficulties exist including providing complete height adjustability, bi-directional driving ability, and a functional, non-slip surface onto which the vehicle's tires can solidly mount and rest.

PRIOR ART

Various constructions of devices have been proposed to provide ramp-type levellers for recreational vehicles, including multi-levelled or 'stackable' devices. U.S. Pat. No. 4,819,910 issued Apr. 11, 1989 to P. F. Johnston describes and illustrates a leveller for recreation vehicles comprising a pair of elongated rectangular interlocking ramp pieces, one to be stacked over the other. Lateral grooves on one piece receive lateral ridges on the other for interlocking. The pieces have, at their longitudinal ends, inclined, ramp-like edges to facilitate the driving of a wheel up onto one or both of the pieces. The non-adjustable width, however, makes the device unsuitable for use on tandem-axled vehicles, and the height can be maintained at only two levels. Further, the textured surface therein described appears insufficient to prevent slippage caused by the tremendous weight that the leveller is subjected to.

Other devices form ramps from only one side, thus not allowing the vehicle to mount and dismount the leveller from both sides. For example, U.S. Pat. No. 4,427,179 issued Jan. 24, 1984 to Price, discloses such a levelling device made of planks of different length forming a ramp from only one side. Further, the planks which determine the height of the leveller do not possess any means for maintaining non-slip contact between the wheel and the leveller.

U.S. Pat. No. 4,836,501 of Baer issued Jun. 6, 1989 and U.S. Pat. No. 3,752,441 of Rogers issued Aug. 14, 1973 (corresponding to Canadian Patent No. 986,907) disclose other construction of multi-level devices which form ramps from only one side and which further do not possess means for stabilizing or maintaining the wheel position on the leveller during wheel engagement.

A variety of patents exist describing interconnecting building blocks, primarily intended for use as toys. U.S. Pat. No. 4,744,780 of Leo S. Volpe issued May 17, 1988 and U.S. Pat. No. 4,606,732 of Ronald Lyman issued Aug. 19, 1986 both describe toy blocks comprising cylindrical pegs and recesses designed to tightly engage therein, creating a frictional 'snap-type' engagement. Moreover, such toy block constructions, if modified and adapted to serve as ramp-type levelling devices for vehicles and the like, on a larger size scale, would be completely impractical since the frictional fit, achieved with the snap-type engagement would be difficult to achieve and to release (the latter particularly after a period of engagement beneath the vehicle of a heavy vehicle).

Another levelling device of background interest is referred to by its trade name "U-B LEVEL". It consists of a step-type ramped leveller forming a ramp at one side and capable of raising the vehicle in steps of 1.5, 3, and 4.5 inches.

Another such device is referred to by its trade-name "Level Life" marketed by ROMTEC INC. This levelling device consists of a wedge-type one piece leveller, possessing a treaded upper surface and being of fixed height and length. It can be used in tandem, adjacent to a similar leveller, for use with a dual-axled vehicle. It does not however possess a flat resting surface for a vehicle's tires.

Thus although the various levellers discussed above seek to provide easy-to-use levelling devices, none of them can be considered to satisfactorily address all of the aforementioned operation considerations, while being economical to manufacture, light weight for ease of operation, and conveniently stackable in a small area for ease of storage.

SUMMARY OF THE INVENTION

According to the present invention there is provided a unit to engage with other similar units to support a wheel of a recreational vehicle or other vehicle for levelling the vehicle. The unit comprises a planar body with upper and lower surfaces circumscribed by edges and pins upwardly extending from spaced locations on the upper surface. The unit also comprises pin-engaging pockets contoured to matably receive corresponding pins of other similar units formed in appropriate locations in the lower surface. The pins, being slightly smaller than their corresponding pockets on said other units, provide association between the units by means of a loose engagement between certain pins of one unit and certain recesses of another one or more similar units.

The levelling device according to the present invention prevents the wheels from slipping from the surface of the leveller during utilization while, at the same time, preventing the stack of units from tipping as the wheels engage therewith. The leveller units are simple to operate and position, needing only to be properly stacked and placed in front of or behind the vehicle's wheels. The shape and loose engagement of the pins and pockets allow the leveller units to maintain their position as they self adjust during operation and ensure ease of separation after use.

The leveller according to the present invention is suitable for all sizes and configurations of vehicle tires and axles.

It is thus an object of the present invention to provide a means for levelling recreational vehicles which overcomes the deficiencies of these known levelling devices.

It is also an object of the present invention to provide a novel construction of a vehicle levelling device for operation in conjunction with recreational vehicles to be arranged and positioned to facilitate the mounting of the vehicle's tires thereupon.

A further object of the present invention is to provide a multi-levelled levelling device capable of forming various configurations of width and height to accommodate a variety of wheel types and sizes.

A still further object of the present invention is to provide a stable means for both mounting and maintaining position on the levelling device.

A still further object of the present invention is to provide a means for allowing the leveller to self-adjust during wheel mounting so as to maintain a proper engagement between the pins and pockets.

A still further object of the present invention is to provide light-weight units possessing pins and pockets that can be easily separated after use and can subsequently be stored in a portable carrying case.

BRIEF DESCRIPTION OF THE DRAWINGS

These and other objects and advantages of the invention will become apparent upon reading the following detailed description and upon referring to the drawings in which.

Figure 1:
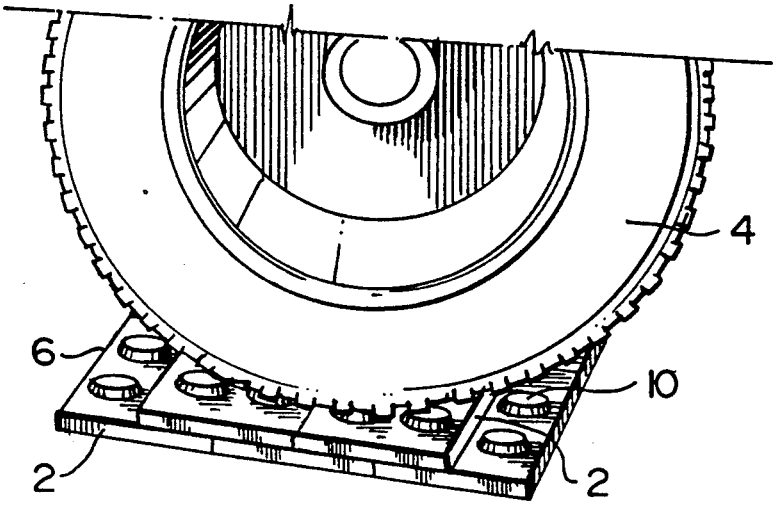
FIG. 1 is a perspective view of a plurality of units in accordance with the present invention supporting, for levelling purposes, the wheel of a vehicle.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Turning to FIG. 1 there is illustrated a plurality of units 2 supporting a wheel 4 of a recreational vehicle or the like, for levelling purposes in accordance with the present invention.

Figure 2:
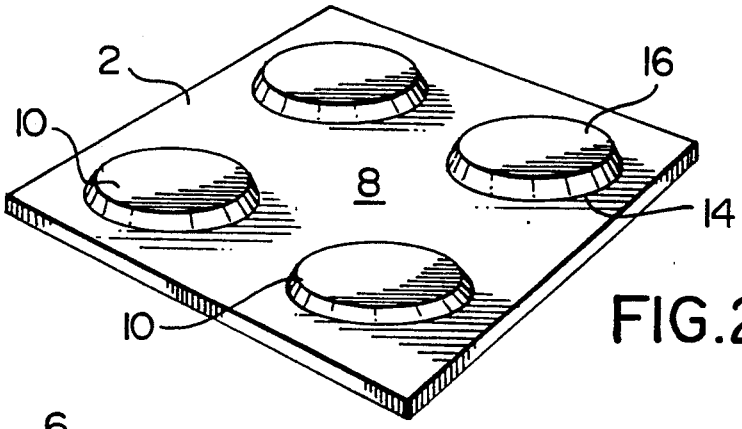
FIG. 2 is a perspective view of an example embodiment of one of the units of FIG. 1 in accordance with the present invention.
Figure 3:
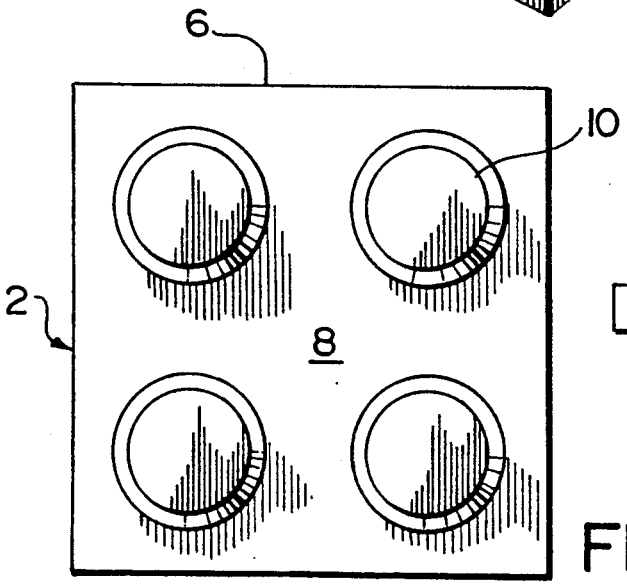
FIG. 3 is a plan view of the unit of FIG. 2, from the top.
Figure 4:
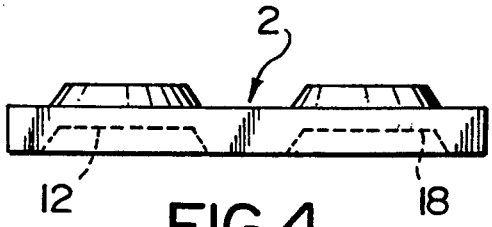
FIG. 4 is a side elevation view of the unit of FIG. 2.

As can be seen in more detail in FIGS. 2 to 4, the units 2 are preferably substantially square in shape bounded by edges 6. Extending upwardly from equally spaced locations in the upper surface 8 of the generally planar unit 2 are a plurality of pins 10. These pins 10 are of equal shape and size, and are aligned in rows parallel to the edges 6 of the unit. The equal spacing of the pins promotes their ability to regularly interlock with pockets 12 of other similar units and is such that each pin 10 is located with respect to its adjacent pins a distance twice the distance between that pin and its adjacent edges.

In the embodiment of FIGS. 2 to 4, the pins 10 are of truncated conical shape, and the pockets 12 are similarly shaped and slightly larger. In this configuration, a loose engagement is maintained between the pins 10 and the corresponding pockets 12 of other units so that slight relative movement is permitted of the pins 10 while remaining within the respective pockets 12.

It is preferred that the pins 10 possess bases 14 of slightly larger transverse cross sectional area than their tops 16, and that the sides of the pins slope marginally outwardly from their tops 16 towards their bases 14.

The lower surface 18 of each unit 2 (FIG. 4) comprises a plurality of pockets 12 which extend into the said lower surface 18. The pockets 12 are of similar shape and size and are also equally-spaced throughout the lower surface of the planar body of the unit so as to be located directly beneath corresponding pins 10. The pockets 12 are slightly larger than the pins 10 so that when engaged, the pins 10 are capable of slight relative movement therein. This movement is intended to facilitate self-stabilizing and adjusting of the units when a plurality of the units are combined for operation, and facilitate dissassembly of the units.

The plurality of units are capable of association by means of an engagement between the pins 10 of one unit 2 and the pockets or recesses 12 of another unit 2. This pin/pocket association permits the individual units to be utilized in combination, thus forming a levelling device of a variety of widths and heights.

Figure 5:
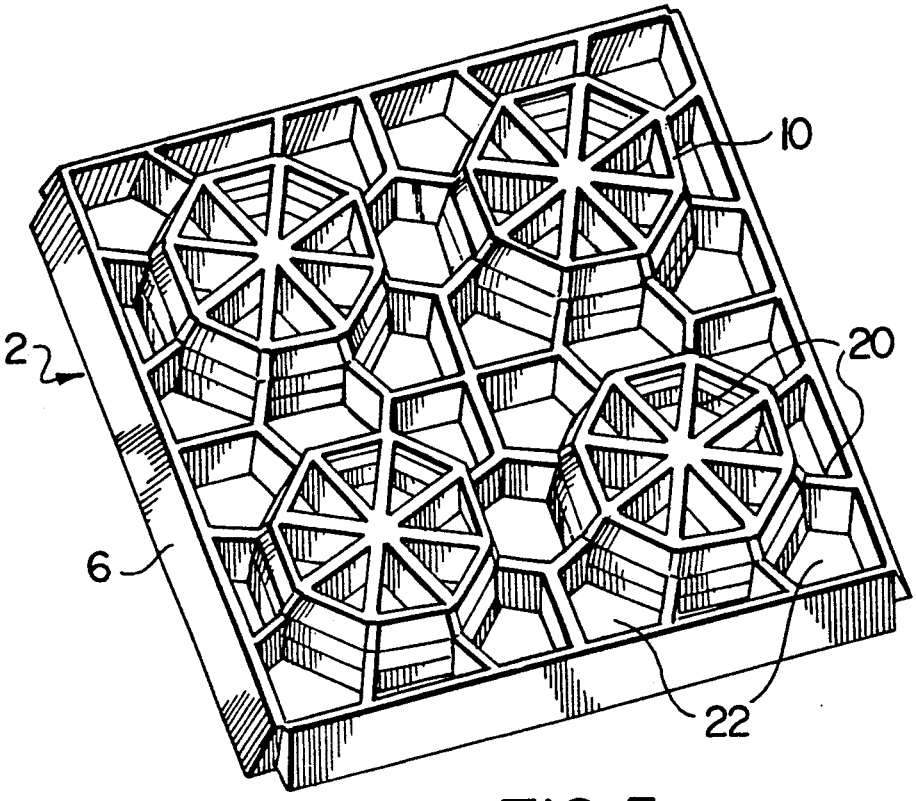
FIG. 5 is a perspective view of an alternative embodiment of unit in accordance with the present invention.
Figure 6:
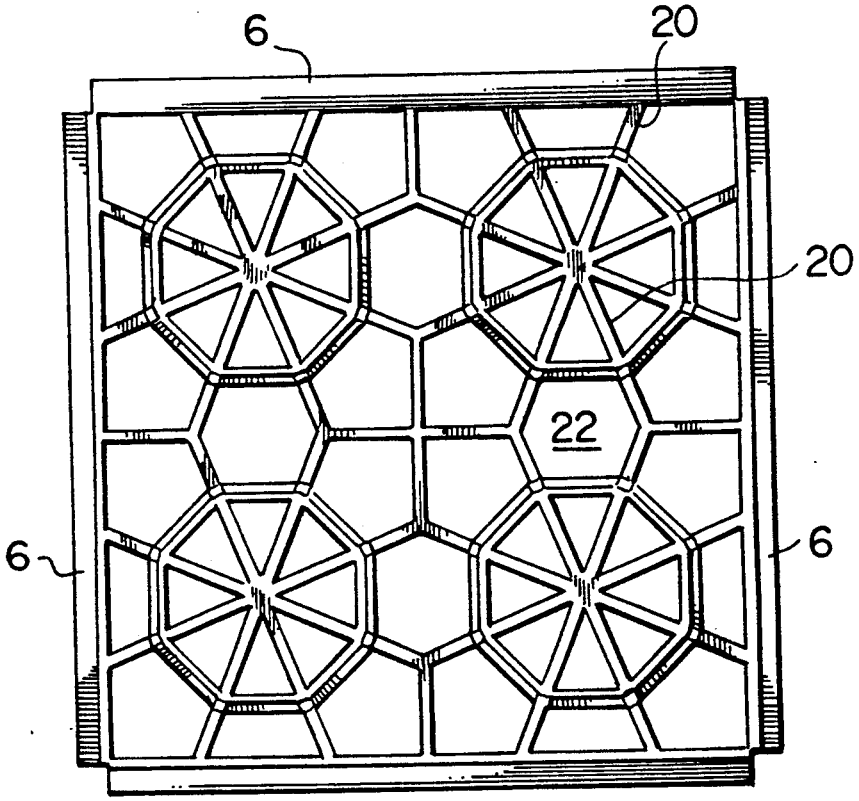
FIG. 6 is a plan view, from the top, of the unit of FIG. 5.
Figure 7:
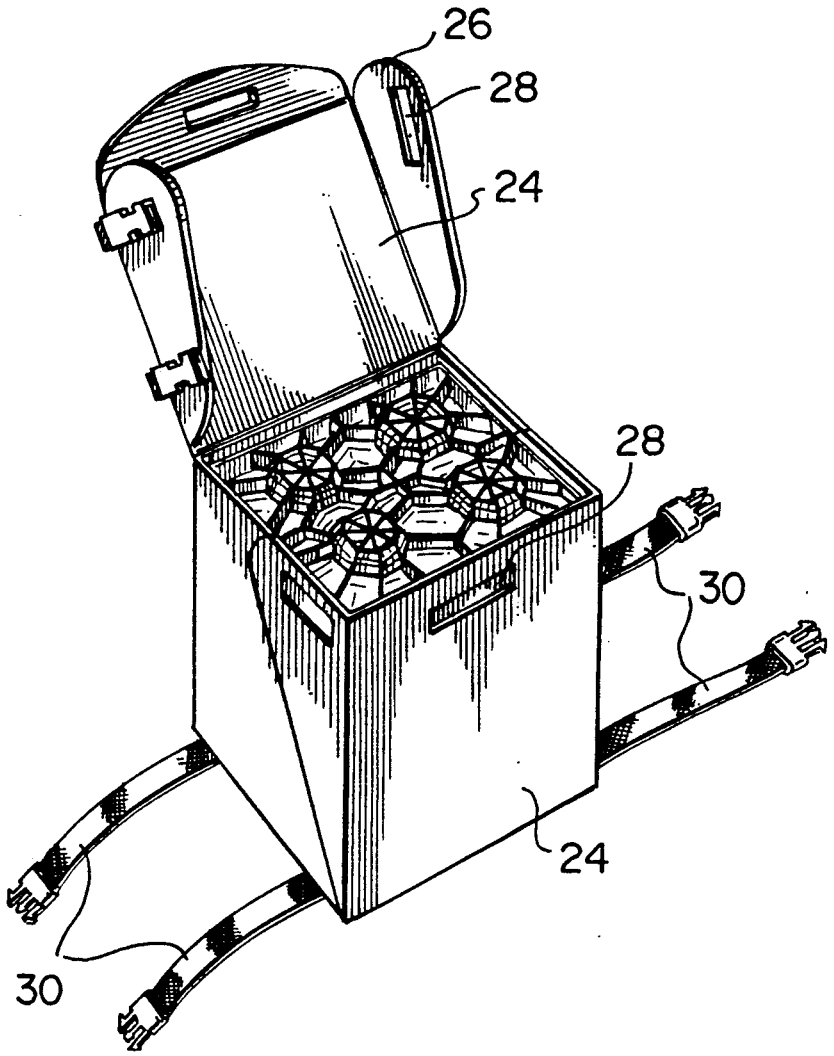
FIG. 7 is a perspective view of a kit, including units in accordance with the present invention and a carrying case.

In the alternative embodiment of the invention illustrated in FIGS. 5 to 7, the pins 10 of the units are of octahedral shape in transverse cross-section, again preferably having sides which are outwardly sloped from top to bottom. The units are similarly square in shape, and are bounded at their perimeters by inwardly sloping edges 6, these edges tapering from bottom to top. In this embodiment, the pockets 12 are of corresponding shape, and slightly larger than the pins 10 so that a loose engagement is maintained when the pins of one unit are received by the corresponding recesses of an upper unit 2. In this embodiment while the body of the units 2 is similarly generally planar, it is composed not of continuous material but rather of a discontinuous webbing 20 containing a plurality of apertures 22 which extend between the upper and lower surface of the body of the unit.

A kit including a case or cover 24 for the effective storage of the units 2 is illustrated in FIG. 7. The cover 24 is made of a fabric material and is of substantially square shape. The cover 24 includes releasably connectable flaps 26 which may be secured in an overlapping fashion as illustrated in order to completely encase the units 2 when stacked one on top of the other. Hook and pile fasteners 28 are used to achieve this releasable connection. Further, a plurality of straps 30 extend about the cover 24 to provide support to the cover and units and also provide handle means for carrying the kit. The square shape of the units maximizes their compactness and facilitates their handling.

In operation, a unit 2, alone or in combination with other such units, provides a means for levelling recreational and other vehicles by providing a surface at a variety of potential heights upon which the wheels of the vehicle can be mounted and rest. The pins extending from the upper surface provide stability to the wheels when mounting, and, when seated in recesses maintain the position of the leveller against lateral or longitudinal displacement.

The units as required are removed from cover 24, the number of units required being dictated by the number of wheels requiring support and the height required to be provided for each of said wheels.

When used in combination, units 2 forming a base or lower level are positioned adjacent to one another with the pins extending upwardly. An upper level is then formed by placing one or more units onto the lower level by engaging pins at an "offset" so that the pockets of an upper level unit receive the pins of two units from the lower level. This process can be repeated, thus forming a desired height. When formed, the levellers provide dual step-type ramped edges permitting the vehicle's wheels to mount from and descend from, either side of the leveller.

Further facilitating the wheel's ability to mount onto the stack of units is the sloped shape of the units' perimeters. These perimeters, having slightly wider bases than upper surfaces, provide a small, preliminary ramp onto which the vehicle's wheels may mount.

The leveller units, when formed to the desired height for lifting and/or levelling a vehicle, are to be placed in front of or behind any number of the vehicle's wheels. The vehicle is then driven slowly up onto the units so that the vehicle's wheels or wheels are mounted thereupon. During the mounting of the wheels, the shape of the perimeter and the loose engagement of the pins and pockets allow the stack of units to adjust to the tremendous weights, while preventing the stacked units from tipping during initial contact of the wheels with the leveller. During mounting, the pin/pocket engagement allows for slight relative movement therebetween allowing the stack of units to adjust itself while preventing the units of corresponding levels to become inseparably bound to each other. Further, the pins 10 extending upwardly from the upper surfaces and which are exposed to the wheels of the vehicle during mounting, provide a surface reducing the possibility of slipping between said surface and the wheels.

When dismounting the leveller, the process is essentially similar but operated in reverse, with the vehicle being able to dismount by travelling either in the forward or reverse direction. The loose pin/pocket engagement allows the units 2 to be easily separated after use then to be suitably stacked and stored in the fabric case cover 20 provided.

Thus it is apparent that there has been provided in accordance with the invention a multi-tiered system of leveller units that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A wheel supporting leveller unit for recreational vehicles or any other vehicles to engage with other similar units to lift and support a wheel of a recreational vehicle or any other vehicle for lifting and levelling that vehicle, the unit comprising a planar body with upper and lower surfaces circumscribed by edges, pins upwardly extending from spaced locations on the upper surface, and pin-engaging pockets of contours to matably receive corresponding pins of other similar units formed in appropriate locations in the lower surface, the pins being slightly smaller than their corresponding pockets on said other units so as to provide association between the units by means of a loose engagement between certain of the pins of one unit and certain of the recesses of another one or more similar units, said pins having an octahedral shape in transverse cross-section and said body being composed of a discontinuous webbing containing a plurality of apertures extending between said upper and lower surfaces, said webbing providing lightweight strength and support of the units, said webbing being such as to form a plurality of similar triangles having a common central apex within each octahedral pin.

2. A unit according to claim 1 wherein the pins are of similar shape and size.

3. A unit according to claim 1 wherein the pockets are disposed directly beneath corresponding pins and extend into said pins.

4. A unit according to claim 2 wherein the pockets are disposed directly beneath corresponding pins and extend into said pins.

5. A unit according to claim 2 wherein the pins and pockets are arranged so that if a pair of units are horizontally aligned adjacent to each other, the pins of adjacent, horizontally-aligned units will engage in corresponding pockets of a similar unit resting thereon.

6. A unit according to claim 1 wherein the upper and lower surfaces are of square configuration.

7. A unit according to claim 6 wherein the pins and pockets are aligned in rows parallel to the edges of the unit, each pin being located from its adjacent pins a distance twice that between that pin and its adjacent edges.

8. A unit according to claim 1 wherein the pins are of truncated conical shape.

9. A unit according to claim 1 wherein the pins are of regularly decreasing transverse cross-sectional area from their bottoms to their tops.

10. A unit according to claim 1 wherein the edges are inwardly sloped from over a distance extending the lower to the upper surface.

11. A unit according to claim 1 wherein the edges are inwardly sloped from over a distance extending the lower to the upper surface.

12. A unit according to claim 1 wherein upper and lower surfaces are of square configuration and the pins are of similar shape and size and wherein the pockets are disposed directly beneath corresponding pins and extend into said pins and wherein the pins and pockets are arranged so that if a pair of units are horizontally aligned adjacent to each other, the pins of adjacent, horizontally-aligned units will engage in corresponding pockets of a similar unit resting thereon, the pins of said units being of octahedral shape when viewed in transverse cross-section, with regularly decreasing transverse cross-sectional area from the bottom to the top, the body of said units being composed of a discontinuous webbing containing a plurality of apertures extending between the upper and lower surfaces, this webbing providing light-weight, strength and support for the unit.

13. A kit comprising a plurality of similar units in accordance with claim 1 for supporting a wheel of a stationary recreational vehicle or other vehicle for levelling said vehicle.

14. A kit comprising a plurality of similar units in accordance with claim 12 for supporting a wheel of a stationary recreational vehicle or other vehicle for levelling said vehicle.

15. A kit according to claim 14 further comprising a carrying case within which the units are normally held when not in use in vertically stacked orientation.

16. A kit according to claim 15 wherein the carrying case comprises a plurality of overlapping, releasably connectable flaps when in secured overlap position the flaps completely encasing the vertically-stacked units, and a plurality of straps extending about the case to support the case and units and provide handles for carrying.

17. A unit according to claim 1, wherein said loose engagement allows self-adjustment of said unit relative to other units when a vehicle is positioned on said units.

18. A unit according to claim 1, wherein each said unit has sufficient size such that it can support the weight of a vehicle received with one of its wheels on said unit.

* * * * *